US007222843B2

(12) United States Patent
Terao et al.

(10) Patent No.: US 7,222,843 B2
(45) Date of Patent: May 29, 2007

(54) SHEET POST-PROCESS APPARATUS

(75) Inventors: Yasunobu Terao, Shizuoka-ken (JP); Hajime Yamamoto, Shizuoka-ken (JP); Yoshiaki Sugizaki, Shizuoka-ken (JP); Reiji Murakami, Kanagawa-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/085,243

(22) Filed: Mar. 22, 2005

(65) Prior Publication Data

US 2006/0066038 A1 Mar. 30, 2006

(30) Foreign Application Priority Data

Sep. 29, 2004 (JP) ..... 2004-285307
Dec. 17, 2004 (JP) ..... 2004-366450

(51) Int. Cl.
*B65H 37/04* (2006.01)

(52) U.S. Cl. ..... 270/58.14; 270/58.18; 270/58.08; 399/410

(58) Field of Classification Search ..... 270/58.08, 270/58.11, 58.12, 58.14, 58.18; 399/410; 271/189, 190, 191, 192
See application file for complete search history.

(56) References Cited

U.S. PATENT DOCUMENTS 4,473,425 A * 9/1984 Baughman et al. ..... 156/356
4,611,741 A * 9/1986 Wilson ..... 227/99
4,794,859 A 1/1989 Huseby et al.
4,898,374 A 2/1990 Vermaat
5,098,074 A 3/1992 Mandel et al.
5,282,611 A 2/1994 Ueda et al.
5,285,249 A * 2/1994 Mahoney ..... 399/410
5,289,251 A 2/1994 Mandel et al.

(Continued)

FOREIGN PATENT DOCUMENTS

JP 62-008965 A 1/1987

(Continued)

OTHER PUBLICATIONS

U.S. Appl. No. 11/085,247, filed Mar. 22, 2005, Terao et al.

(Continued)

*Primary Examiner*—Patrick Mackey
(74) *Attorney, Agent, or Firm*—Foley & Lardner LLP

(57) ABSTRACT

A sheet post-process apparatus has a standby tray for putting a sheet delivered from an image forming apparatus on standby, a process tray arranged under the standby tray for stacking the sheet dropped from the standby tray or the sheet delivered from the image forming apparatus not through the standby tray, a matching mechanism for matching a lateral direction of the sheet stacked on the process tray by a lateral matching plate to form a sheet bundle, a post-process mechanism for post-processing the sheet bundle matched by the matching mechanism, and a delivery tray for delivering the sheet bundle post-processed by the post-process mechanism, in which the process tray and the standby tray are arranged so as to make a height of an upper end of the lateral matching plate of the process tray higher than a height of a lower end of the standby tray.

20 Claims, 12 Drawing Sheets

U.S. PATENT DOCUMENTS

| | | | | |
|---|---|---|---|---|
| 5,435,544 | A | 7/1995 | Mandel | |
| 5,451,037 | A | 9/1995 | Lundstrom | |
| 5,628,502 | A | 5/1997 | Amarakoon | |
| 5,676,517 | A * | 10/1997 | Lotz | 414/793.4 |
| 5,709,376 | A | 1/1998 | Ushirogata | |
| 5,934,140 | A | 8/1999 | Jackson et al. | |
| 5,961,274 | A * | 10/1999 | Bors | 414/791 |
| 5,971,384 | A | 10/1999 | Asao | |
| 6,065,747 | A | 5/2000 | Khovaylo et al. | |
| 6,092,948 | A | 7/2000 | Altfather | |
| 6,231,039 | B1 | 5/2001 | Chung | |
| 6,330,999 | B2 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,450,934 | B1 | 9/2002 | Coombs | |
| 6,641,129 | B2 | 11/2003 | Ogita et al. | |
| 6,671,492 | B2 | 12/2003 | Mimura et al. | |
| 6,698,744 | B2 | 3/2004 | Yamada et al. | |
| 6,712,349 | B2 | 3/2004 | Watanabe | |
| 6,722,646 | B2 | 4/2004 | Sekiyama et al. | |
| 6,733,006 | B2 | 5/2004 | Kobayashi et al. | |
| 6,819,906 | B1 | 11/2004 | Herrmann et al. | |
| 6,824,128 | B2 | 11/2004 | Nagata et al. | |
| 6,910,686 | B2 | 6/2005 | Awano | |
| 6,928,259 | B2 | 8/2005 | Sakuma | |
| 2002/0047233 | A1 | 4/2002 | Coombs et al. | |
| 2002/0163119 | A1 | 11/2002 | Kawata | |
| 2004/0113348 | A1 | 6/2004 | Awano | |
| 2004/0126163 | A1 | 7/2004 | Asami et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 06-099070 | B2 | 12/1994 |
| JP | 10-279160 | A | 10/1998 |
| JP | 2001089009 | A * | 4/2001 |
| JP | 2003-081517 | A | 3/2003 |

OTHER PUBLICATIONS

U.S. Appl. No. 11/085,226, filed Mar. 22, 2005, Terao et al.
U.S. Appl. No. 11/085,248, filed Mar. 22, 2005, Terao et al.
U.S. Appl. No. 11/085,227, filed Mar. 22, 2005, Terao et al.
U.S. Appl. No. 11/085,244, filed Mar. 22, 2005, Terao et al.
U.S. Appl. No. 11/085,242, filed Mar. 22, 2005, Terao et al.
U.S. Appl. No. 11/085,241, filed Mar. 22, 2005, Terao et al.
U.S. Appl. No. 11/085,250, filed Mar. 22, 2005, Terao et al.
U.S. Appl. No. 11/085,240, filed Mar. 22, 2005, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,222, filed Dec. 10, 2004, Terao et al.
U.S. Appl. No. 11/008,381, filed Dec. 10, 2004, Terao et al.
U.S. Appl. No. 11/008,132, filed Dec. 10, 2004, Terao et al.
U.S. Appl. No. 11/008,131, filed Dec. 10, 2004, Terao et al.
U.S. Appl. No. 11/008,142, filed Dec. 10, 2004, Terao et al.
U.S. Appl. No. 11/008,199, filed Dec. 10, 2004, Terao et al.
U.S. Appl. No. 11/008,145, filed Dec. 10, 2004, Terao et al.
U.S. Appl. No. 11/008,124, filed Dec. 10, 2004, Terao et al.
U.S. Appl. No. 11/008,350, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,349, filed Dec. 10, 2004, Terao et al.
U.S. Appl. No. 11/008,294, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,290, filed Dec. 10, 2004, Terao et al.
U.S. Appl. No. 11/008,392, filed Dec. 10, 2004, Terao et al.
U.S. Appl. No. 11/008,299, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,295, filed Dec. 10, 2004, Terao et al.
U.S. Appl. No. 11/008,251, filed Dec. 10, 2004, Terao et al.
U.S. Appl. No. 11/008,122, filed Dec. 10, 2004, Sasahara.
U.S. Appl. No. 11/008,567, filed Dec. 10, 2004, Terao et al.
U.S. Appl. No. 11/085,251, filed Mar. 22, 2005, Ilzuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., Notice of Allowance and Fee(s) Due, U.S. Appl. No. 11/008,132, Oct. 6, 2005, 9 pages.
Y. Terao et al., U.S. PTO Office Action, U.S. Appl. No. 11/008,122, Nov. 21, 2005, 9 pages.
Y. Terao et al., U.S. PTO Office Action, U.S. Appl. No. 11/008,131, Feb. 23, 2006, 9 pgs.
Y. Terao et al., U.S. PTO Office Action, U.S. Appl. No. 11/008,148, Jan. 11, 2006, 12 pages.
Y. Terao et al., U.S. PTO Office Action, U.S. Appl. No. 11/008,222, Feb. 24, 2006, 12 pgs.
Y. Terao et al., U.S. PTO Office Action, U.S. Appl. No. 11/008,224, Nov. 21, 2005, 9 pages.
Y. Terao et al., U.S. PTO Office Action, U.S. Appl. No. 11/008,230, Feb. 24, 2006, 11 pgs.
Y. Terao et al., U.S. PTO Office Action, U.S. Appl. No. 11/008,251, Jan. 13, 2006, 11 pages.
Y. Terao et al., U.S. PTO Office Action, U.S. Appl. No. 11/008,257, Nov. 30, 2005, 9 pages.
Y. Terao et al., U.S. PTO Office Action, U.S. Appl. No. 11/008,271, Nov. 30, 2005, 9 pages.
Y. Terao et al., U.S. PTO Office Action, U.S. Appl. No. 11/008,290, Nov. 30, 2005, 9 pages.
Y. Terao et al., U.S. PTO Office Action, U.S. Appl. No. 11/008,295, Jan. 5, 2006, 11 pages.
Y. Terao et al., U.S. PTO Office Action, U.S. Appl. No. 11/008,350, Jan. 26, 2006, 12 pages.
Y. Terao et al., U.S. PTO Office Action, U.S. Appl. No. 11/008,392, Dec. 14, 2005, 9 pages.
Y. Terao et al., U.S. PTO Office Action, U.S. Appl. No. 11/085,226, Jan. 13, 2006, 9 pgs.
Y. Terao et al., U.S. PTO Office Action, U.S. Appl. No. 11/085,227, Feb. 9, 2006, 9 pgs.
Y. Terao et al., U.S. PTO Office Action, U.S. Appl. No. 11/085,240, Jan. 26, 2006, 8 pgs.
Y. Terao et al., U.S. PTO Office Action, U.S. Appl. No. 11/085,241, Feb. 9, 2006, 9 pgs.
Y. Terao et al., U.S. PTO Office Action, U.S. Appl. No. 11/085,244, Feb. 9, 2006, 7 pgs.
Y. Terao et al., U.S. PTO Office, U.S. Appl. No. 11/008,294, Dec. 13, 2005, 9 pages.
Y. Terao et al., U.S. PTO Office, U.S. Appl. No. 11/008,299, Dec. 13, 2005, 9 pages.
Y. Terao et al., U.S. PTO Office, U.S. Appl. No. 11/008,349, Dec. 13, 2005, 9 pages.
Y. Terao et al., U.S. PTO Office, U.S. Appl. No. 11/008,567, Dec. 13, 2005, 9 pages.
Y. Terao, et al., Notice of Allowance and Fee(s) Due, U.S. Appl. No. 11/008,124, Sep. 30, 2005, 9 pages.
K. Sasahara et al., U.S. PTO Office Action, U.S. Appl. No. 11/008,122, Apr. 19, 2006, 10 pages.
Y. Terao et al., Notice of Allowance and Fee(s) Due, U.S. Appl. No. 11/008,199, Apr. 20, 2006, 15 pages.
Y. Terao et al., Notice of Allowance and Fee(s) Due, U.S. Appl. No. 11/008,247, May 1, 2006, 16 pages.
Y. Terao et al., Notice of Allowance and Fee(s) Due, U.S. Appl. No. 11/008,349, May 2, 2005, 9 pages.
Y. Terao et al., U.S. PTO Office Action, U.S. Appl. No. 11/008,224, Apr. 21, 2006, 12 pages.
Y. Terao et al., U.S. PTO Office Action, U.S. Appl. No. 11/008,257, Apr. 28, 2006, 13 pages.
Y. Tarao et al., U.S. PTO Office Action, U.S. Appl. No. 11/008,271, Apr. 25, 2006, 14 pages.
Y. Terao et al., U.S. PTO Office Action, U.S. Appl. No. 11/008,294, May 5, 2006 13 pages.

Y. Terao et al., U.S. PTO Office Action, U.S. Appl. No. 11/008,299, May 5, 2006, 12 pages.
Y. Terao et al., U.S. PTO Office Action, U.S. Appl. No. 11/008,392, Apr. 26, 2006, 10 pages.
Y. Terao et al., Notice of Allowance and Fee(s) Due, U.S. Appl. No. 11/008,148, Jun. 26, 2006, 10 pages.
Y. Terao et al., Notice of Allowance and Fee(s) Due, U.S. Appl. No. 11/008,251, Jun. 26, 2006, 10 pages.
Y. Terao et al., Notice of Allowance and Fee(s) Due, U.S. Appl. No. 11/085,241, Jun. 26, 2006, 10 pages.
Y. Terao et al., U.S. PTO Office Action, U.S. Appl. No. 11/008,132, Jun. 9, 2006, with attached Notice of Withdrawal from Issue dated May 30, 2006, 11 pgs.
Y. Terao et al., U.S. PTO Office Action, U.S. Appl. No. 11/008,295, Jun. 23, 2006, 14 pgs.
Y. Terao et al., Notice of Allowance and Fee(s) Due, U.S. Appl. No. 11/085,244, Jul. 13, 2006, 10 pages.
Y. Terao et al., U.S. PTO Office Action, U.S. Appl. No. 11/008,145, Jun. 30, 2006, 6 pgs.
Y. Terao et al., U.S. PTO Office Action, U.S. Appl. No. 11/008,147. Jul. 7, 2006, 4 pgs.
Y. Terao et., U.S. PTO Office Action, U.S. Appl. No. 11/008,290, Jul. 21, 2006, 15 pgs.
Y. Terao et al., U.S. PTO Office Action, U.S. Appl. No. 11/008,350, Jul. 6, 2006, 12 pgs.
Y. Terao et al., U.S. PTO Office Action, U.S. Appl. No. 11/085,226, Jul. 20, 2006, 12 pages.
Y. Terao et al., U.S. PTO Office Action, U.S. Appl. No. 11/085,227, Aug. 11, 2006, 15 pages.
Y. Terao et al., U.S. PTO Office Action, U.S. Appl. No. 11/085,240, Aug. 2, 2006, 15 pages.
Y. Terao et al., U.S. PTO Office Action, U.S. Appl. No. 11/085,247, Jul. 13, 2006, 14 pgs.
Y. Terao et al., U.S. PTO Office Action, U.S. Appl. No. 11/085,248, Jul. 5, 2006, 15 pgs.
Y. Terao et al., U.S. PTO Office Action, U.S. Appl. No. 11/085,256, Jul. 13, 2006, 13 pgs.
Y. Terao et al., U.S. PTO Office Action, U.S. Appl. No. 11/085,625, Jul. 28, 2006, 13 pgs.
Y. Terao, et al., Notice of Allowance and Fee(s) Due, U.S. Appl. No. 11/008,122, Jul. 26, 2006, 8 pgs.
Y. Terao et al., Notice of Allowance and Fee(s) Due, U.S. Appl. No. 11/008,392, Sep. 15, 2006, 10 pages.
Y. Terao et al., U.S. PTO Office Action, U.S. Appl. No. 11/008,381, Aug. 23, 2006, 17 pages.
Y. Terao et al., U.S. PTO Office Action, U.S. Appl. No. 11/008,567, Aug. 21, 2006, 14 pages.
Y. Terao, et al., Notice of Allowance and Fee(s) Due, U.S Appl. No. 11/008,222, Aug. 31, 2006, 12 pgs.
Y. Terao, et al., Notice of Allowance and Fee(s) Due, U.S. Appl. No. 11/008,299, Sep. 6, 2006, 9 pgs.

* cited by examiner

SHEET POST-PROCESS APPARATUS

CROSS-REFERENCE TO RELATED APPLICATION

This application claims priority of Japanese Patent Application No. 2004-285307, filed on Sep. 29, 2004 and Japanese Patent Application No. 2004-366450, filed on Dec. 17, 2004. Contents of these Japanese Paten Applications are cited here, and incorporated with this application.

BACKGROUND OF THE INVENTION

1. Field of the Invention

The present invention relates to a sheet post-process apparatus or the like which conducts a post process of a sheet, such as a sheet of paper, etc., to be discharged from an image forming apparatus, such as a composite apparatus of a copying machine, a printer, a multi function peripheral (MFP), and so on.

2. Description of the Related Art

A post-process apparatus (finisher) which conducts a process (staple process) for bundling and fixing a plurality of sheets printed by the MFP, is known. The finisher sequentially conveys the sheets fed from the MFP to a process tray, binds the sheets by a stapler, and delivers the stapled sheets to a delivery tray.

Since a binding process by the stapler exists in this post process of the finisher, it needs a delaying mechanism for absorbing a process speed in the MFP. Therefore, a technology for lengthening a conveying path is known (refer to Japanese Patent Publication No. 6-99070). For this reason, it has been difficult to sufficiently reduce the size of the apparatus.

Furthermore, an apparatus for delivering a sheet to an accumulation tray is known as disclosed in Japanese Patent Application Laid-Open Publication No. 10-279160, but the apparatus is not sufficient.

BRIEF SUMMARY OF THE INVENTION

An object of the present invention is to provide a sheet post-process apparatus in which a distance from a sheet delivery unit to a process mechanism for post-processing of an image forming apparatus is shortened and a size is reduced. Another object of the present invention is to provide a sheet post-process apparatus having a structure for preventing a sheet from being sandwiched between a standby tray and a lateral matching plate and further raising matching properties in a lateral direction.

According to an aspect of the present invention, there is provided a sheet post-process apparatus comprising: a standby tray for putting a sheet delivered from an image forming apparatus on standby; a process tray arranged under the standby tray for stacking the sheet dropped from the standby tray or the sheet delivered from the image forming apparatus not through the standby tray; a matching mechanism for matching a lateral direction of the sheet stacked on the process tray by a lateral matching plate to form a sheet bundle; a post-process mechanism for post-processing the sheet bundle matched by the matching mechanism; and a delivery tray for delivering the sheet bundle post-processed by the post-process mechanism, in which the process tray and the standby tray are arranged so as to make a height of an upper end of the lateral matching plate of the process tray higher than a height of a lower end of the standby tray.

DETAILED DESCRIPTION OF THE INVENTION

Now, preferred embodiments of the present invention applied to an MFP will be described in greater detail by referring to the accompanying drawings.

Figure 1:
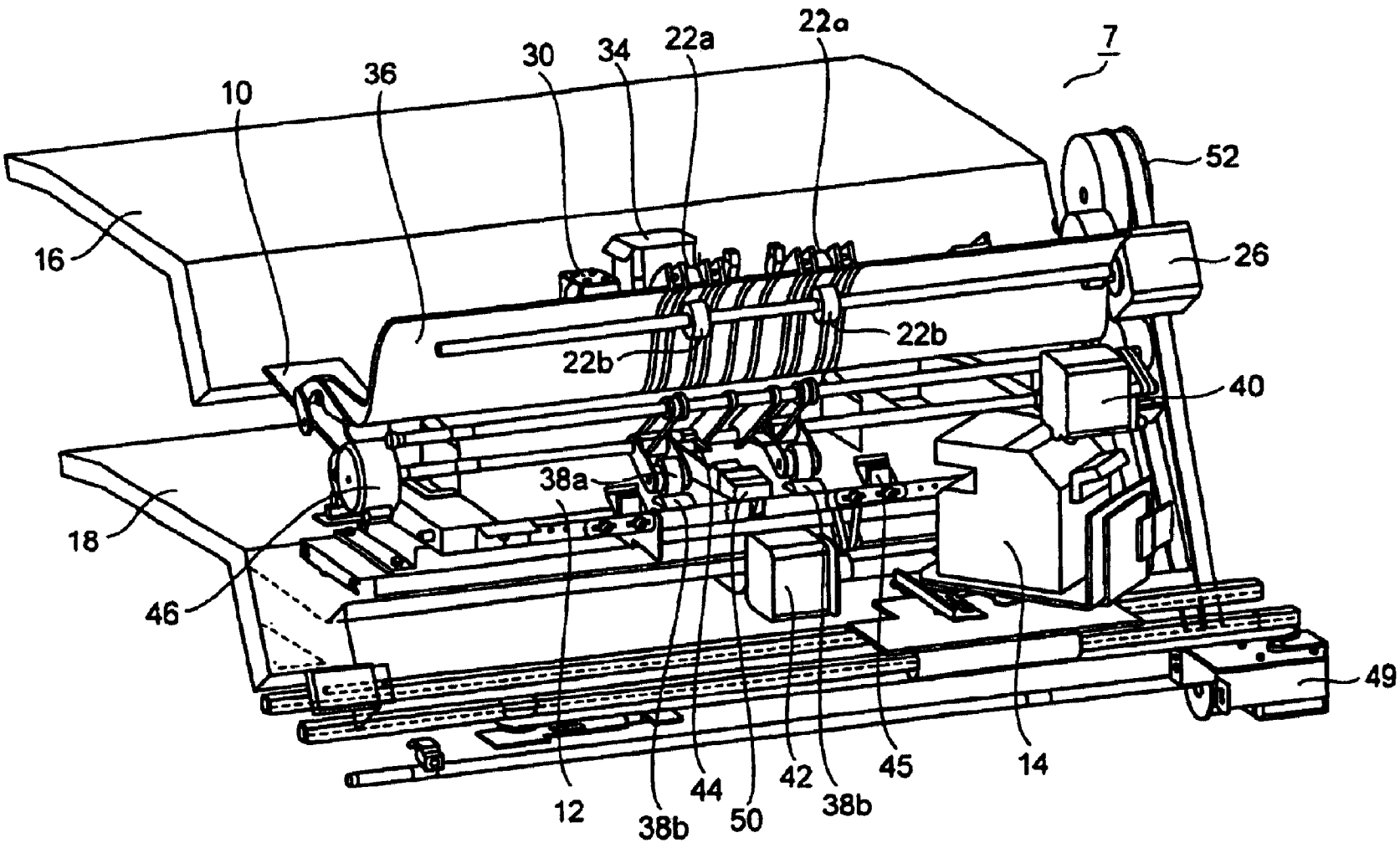
FIG. 1 is a perspective view of a sheet post-process apparatus according to an embodiment of the present invention.
Figure 2:
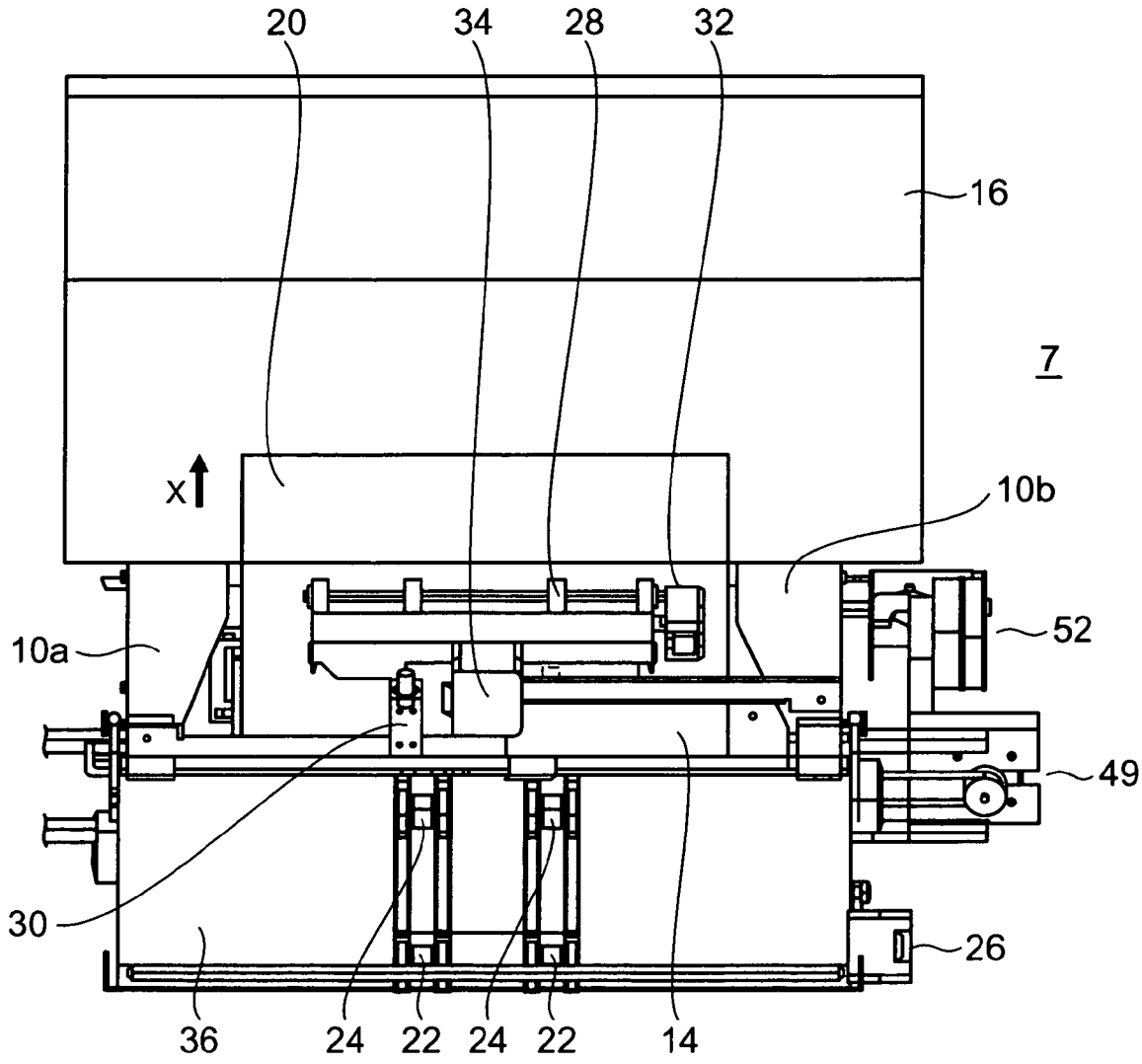
FIG. 2 is a top view of the sheet post-process apparatus according to the embodiment of the present invention.

FIG. 1 is a perspective view of a post-process apparatus according to an embodiment of the present invention, and FIG. 2 is a top view of this post-process apparatus. The post-process apparatus 7 fundamentally comprises a standby tray 10, a process tray 12, a stapler 14, a first sheet delivery tray 16, and a second sheet delivery tray 18.

A sheet 20 fed from the MFP is received by a pair of inlet rollers 22, supplied to a pair of sheet feed rollers 24, and sent from the sheet feed rollers 24 to the standby tray 10 (in a conveying direction X). The inlet rollers 22 are driven by an inlet roller motor 26. The inlet rollers 22 include upper inlet rollers 22*a* and lower inlet rollers 22*b*. The sheet feed rollers 24 include an upper sheet feed roller 24*a* and a lower sheet feed roller 24*b*.

The standby tray 10 includes, as shown in FIG. 2, a pair of standby tray components 10*a*, 10*b* which can move laterally, and receives the sheet in the state that the standby tray components 10*a* and 10*b* are closed. In order to match the sheet in this state, standby tray rollers 28 are provided.

The standby tray rollers 28 are vertically movable, and are controlled by a standby tray roller drive source 30. The standby tray rollers 28 are rotated by a standby tray roller motor 32.

Figure 3:
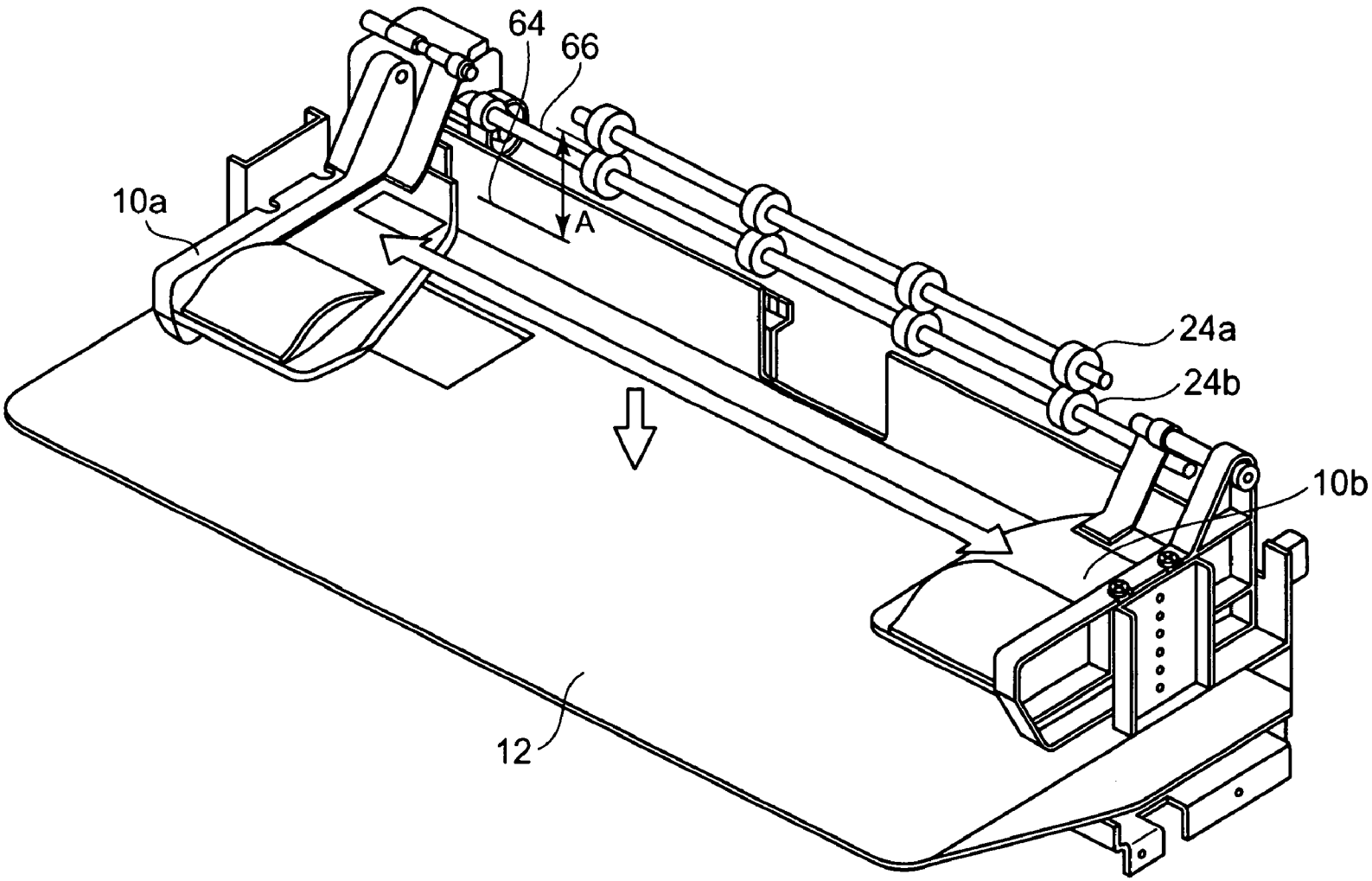
FIG. 3 is a view for explaining an operation of a standby tray in the sheet post-process apparatus according to the embodiment of the present invention.

When a predetermined number of sheets, for example, two sheets are accumulated in the standby tray 10, as shown in FIG. 3, the standby tray components 10*a* and 10*b* are opened laterally in a direction perpendicular to the sheet conveying direction X by the standby tray motor 34, and the sheet 20 is dropped by its own weight in the process tray 12. This operation is called an active drop.

A paper path is provided to guide the sheet fed from the MFP to the standby tray 10 and the process tray 12. This paper path is composed of a paper path ceiling 36 as shown in FIG. 2.

Figure 4:
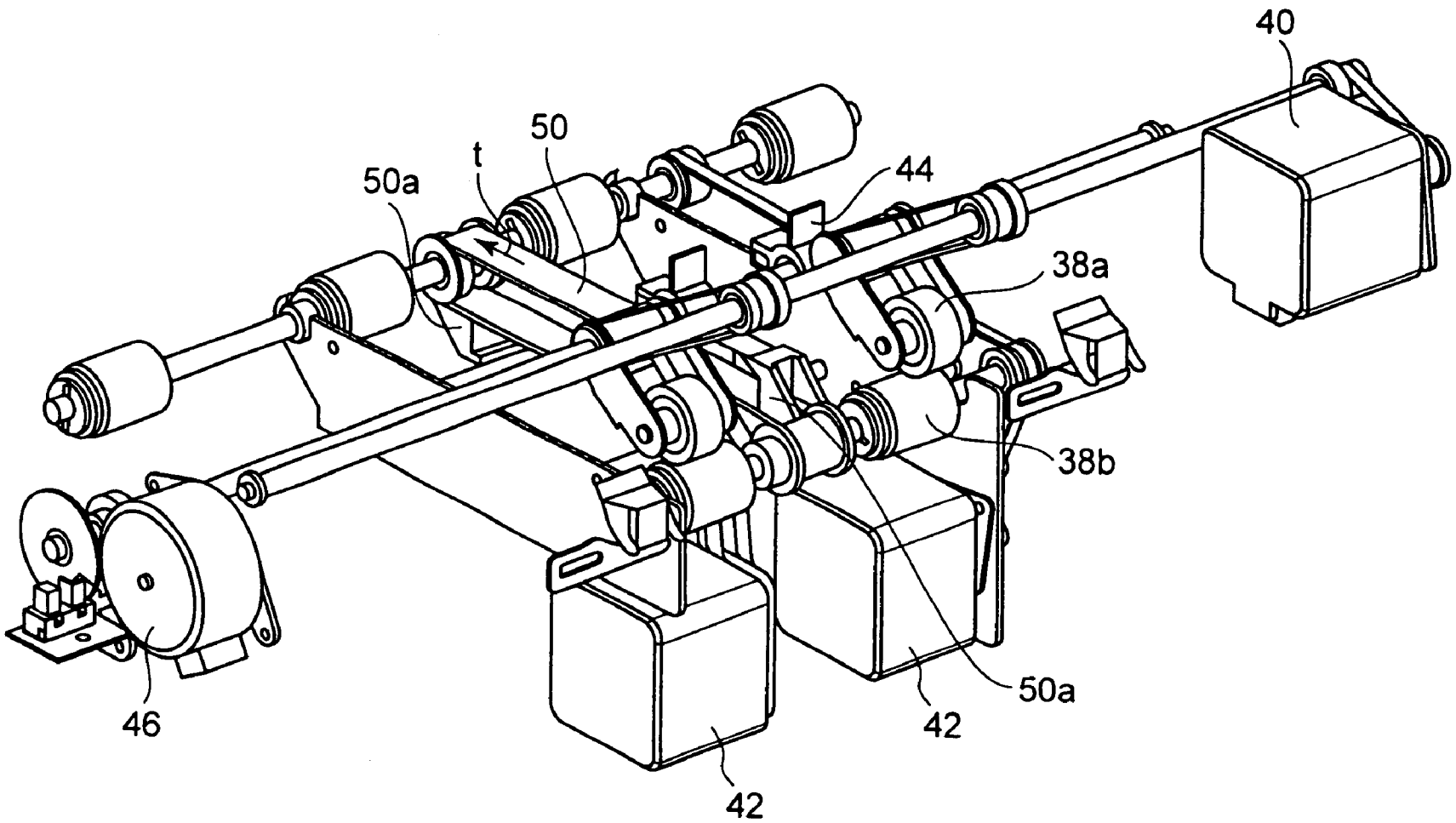
FIG. 4 is a view for explaining longitudinal matching and a sheet bundle conveying mechanism in the sheet post-process apparatus according to the embodiment of the present invention.

Matching processes in a longitudinal direction (sheet conveying direction) and a lateral direction are performed to the sheet sent to the process tray 12. In the longitudinal matching, as shown in FIG. 4, sheets are aligned with a stopper 45 as a reference by a longitudinal matching upper roller 38*a* driven by a longitudinal matching upper roller motor 40 and a longitudinal matching lower roller 38*b* driven by a longitudinal matching lower roller motor 42.

Incidentally, when the sheet is fed to the process tray 12, the longitudinal matching upper roller 38*a* becomes a state that the upper roller 38*a* is opened so as not to come into contact with the longitudinal matching lower roller 38*b* by the longitudinal matching upper roller motor 40. A paddle 44 is provided to supplement this matching, and is driven by a paddle motor 46.

Figure 5:
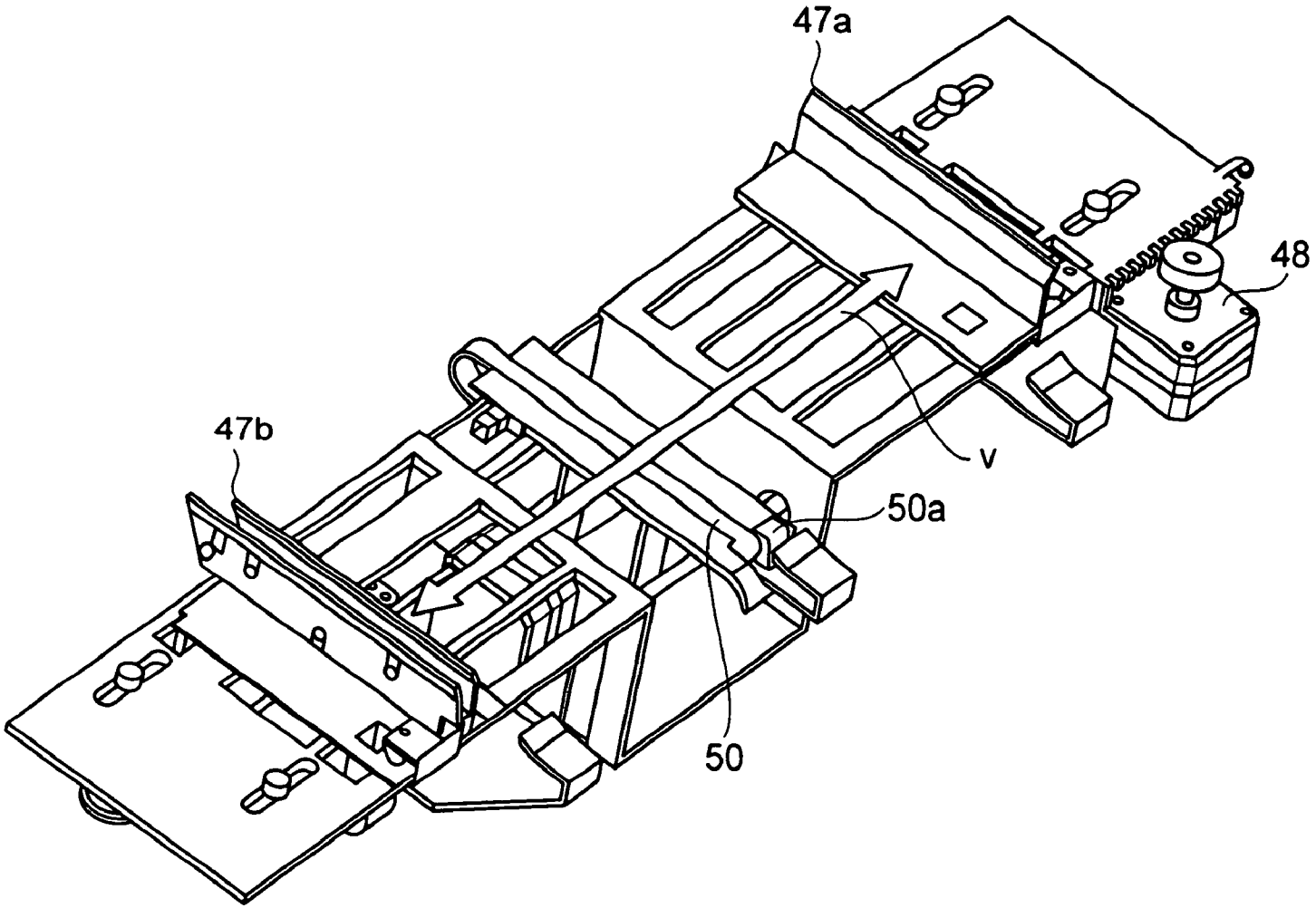
FIG. 5 is a view for explaining a lateral matching mechanism in the sheet post-process apparatus according to the embodiment of the present invention.

On the other hand, the lateral matching is performed by moving of the first and second lateral matching plates 47*a*, 47*b* to an arrow v by a lateral matching mechanism 47 and a lateral matching motor 48, as shown in FIG. 5.

Figure 6:
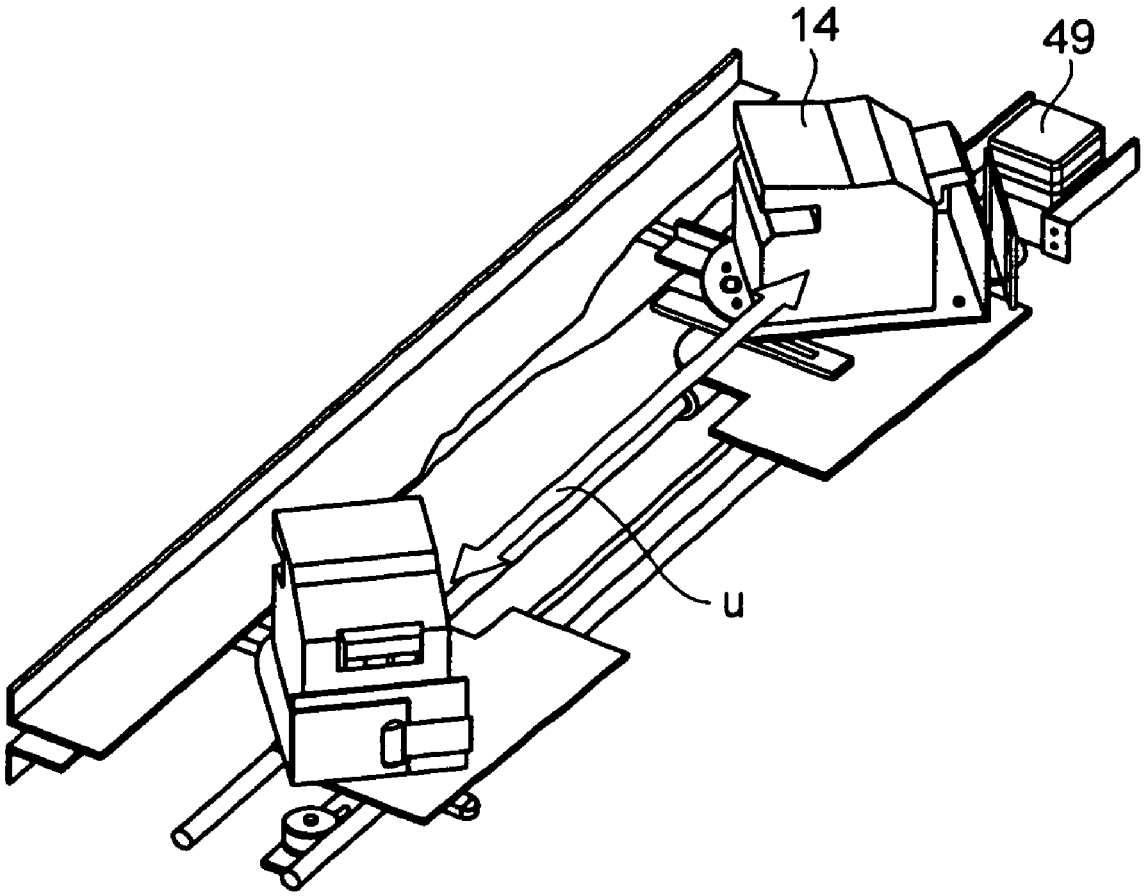
FIG. 6 is a view for explaining an operation of a stapler in the sheet post-process apparatus according to the embodiment of the present invention.

When a predetermined number of sheets are matched and stored in the process tray 12, as shown in FIG. 6, the staple process is conducted by a stapler 14. The stapler 14 is moved to an arrow u and positioned by a staple driver 49 to control the staple process.

Figure 8:
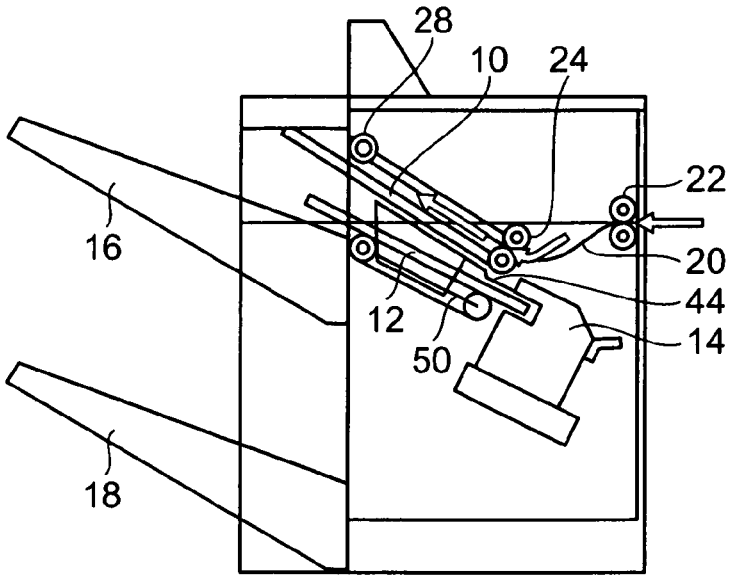
FIG. 8 is a view for explaining a flow of a first sheet between an inlet roller and a sheet feed roller in the sheet post-process apparatus according to the embodiment of the present invention.

The staple processed sheet bundles are sent to first and second sheet delivery trays 16 and 18 shown in FIG. 8 by the conveying mechanism 50 shown in FIG. 4. The first and second sheet delivery trays 16 and 18 are selected by vertically moving these sheet delivery trays by a sheet delivery tray driver 52.

As shown in FIG. 3, a step A is provided between a lower surface 64 of the standby tray 10 and a contact surface 66 of the sheet feed roller 24*a* and the sheet feed roller 24*b*. If there is no step A, a lower curled sheet supplied to the standby tray 10 blocks the sheet feed roller 24*b*, a jam or irregular stacking order of sheets occurs so that the sheet might drop in the process tray 12. This step A is provided to prevent such an inconvenience.

Incidentally, in this embodiment of the present invention, the relationship between a height of upper ends of the first and second lateral matching plates 47*a*, 47*b* for constituting the lateral matching mechanism 47 shown in FIG. 5 and a height of a lower end of the standby tray 10 is set to a predetermined relation.

Figure 7A:
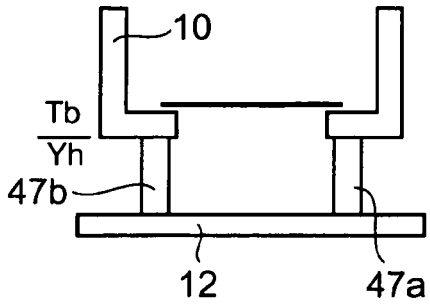
FIGS. 7A to 7D are views for explaining the relationship between a standby tray and a lateral matching plate in the sheet post-process apparatus according to the embodiment of the present invention.
Figure 7B:
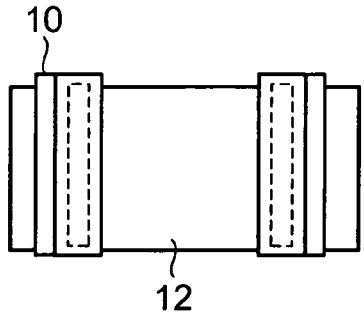

More particularly, the embodiment shown in FIGS. 7A and 7B has a structure that height Yh of the upper ends of the first and second lateral matching plates 47*a* and 47*b* is the same as a height Tb of the lower end of the standby tray. That is, in this embodiment, the upper ends of the lateral matching plates 47*a* and 47*b* come into contact with the lower end of the standby tray 10.

Figure 7C:
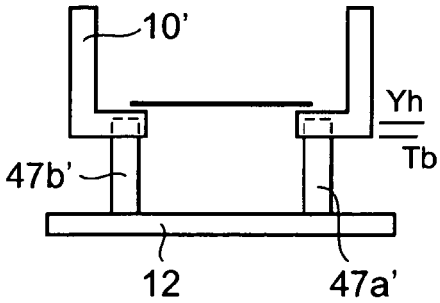
Figure 7D:
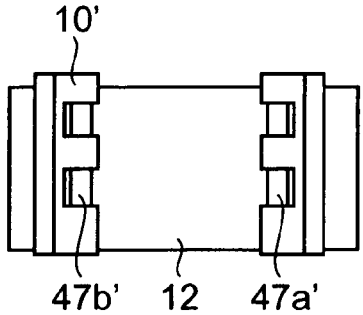

On the other hand, in the embodiment shown in FIGS. 7C and 7D, the height Yh of the upper ends of first and second lateral matching plates 47*a*' and 47*b*' is higher than the height Tb of the lower end of the standby tray 10. The standby tray 10' of this case becomes a comb-like teeth state in a structure that the comb-like teeth are engaged with comb-like teeth of the upper ends of the lateral matching plates 47*a*' and 47*b*'. Thus, an effect of suppressing a sheet jam is further provided.

It is difficult to constitute the standby tray and the lateral matching plate of one member, and a conventional apparatus has a gap between the lower end of the standby tray and the upper end of the lateral matching plate. Therefore, the sheet becomes a jam state due to rise or contact of the sheet on or with this gap, and the matching properties are not proper.

In the embodiment shown in FIGS. 7A and 7B, or the embodiment shown in FIGS. 7C and 7D, the height Yh of the upper end of the lateral matching plate is the same as or higher than the height Tb of the lower end of the standby tray. Therefore, the sheet may not be sandwiched between the standby tray and the lateral matching plate as in the conventional, but finally matching properties of the sheets are raised, and a jam state of sheet can be suppressed.

Then, an operation of the post-process apparatus according to the present invention will be described with reference to FIG. 8 to FIG. 18. As shown in FIG. 8, the sheet 20 fed from the MFP is sent to the sheet feed rollers 24 as shown by an arrow via the inlet roller 22.

Figure 9:
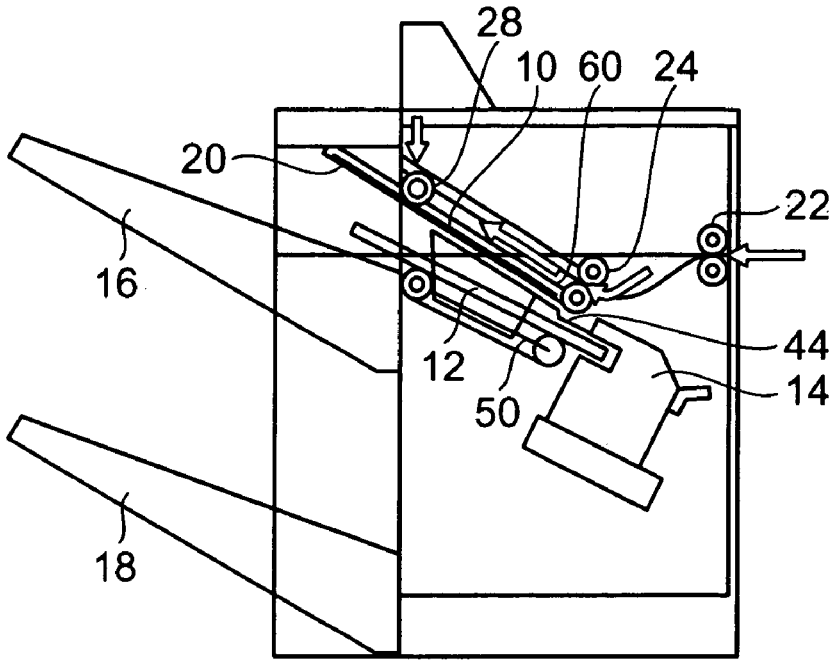
FIG. 9 is a view for explaining the flow of the first sheet between the sheet feed roller and the standby tray in the sheet post-process apparatus according to the embodiment of the present invention.
Figure 10:
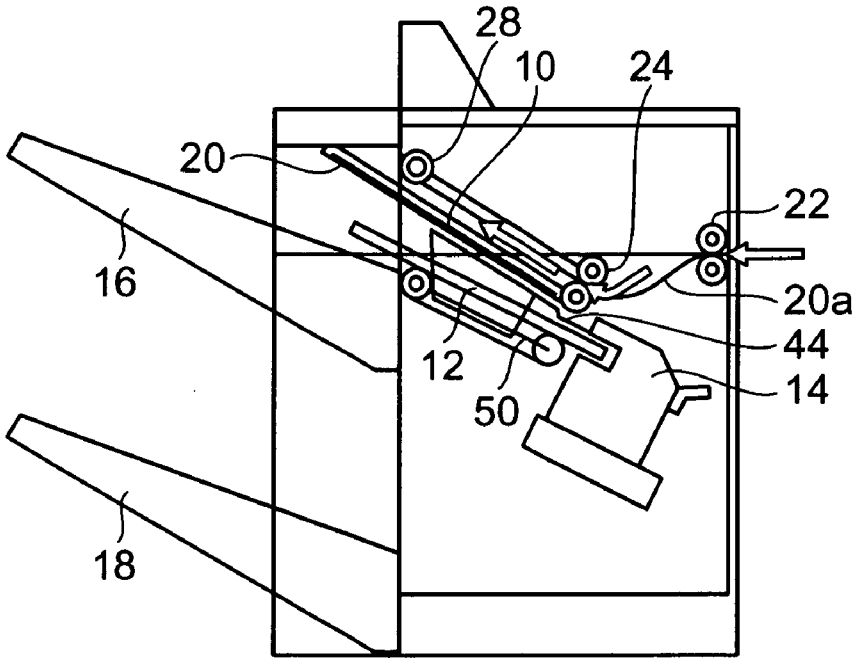
FIG. 10 is a view for explaining a flow of a second sheet between the sheet feed roller and the standby tray in the sheet post-process apparatus according to the embodiment of the present invention.

Then, as shown in FIG. 9, a first sheet is stored in the standby tray 10 through the sheet feed rollers 24. At this time, the standby tray roller 28 is lowered as shown by an arrow to match the position of the sheet 20 supplied to the standby tray 10 to a rear end (upstream side) 60 of the standby tray 10. Then, as shown in FIG. 10, the standby tray roller 28 is raised to prepare receiving of a second sheet 20*a*.

Figure 11:
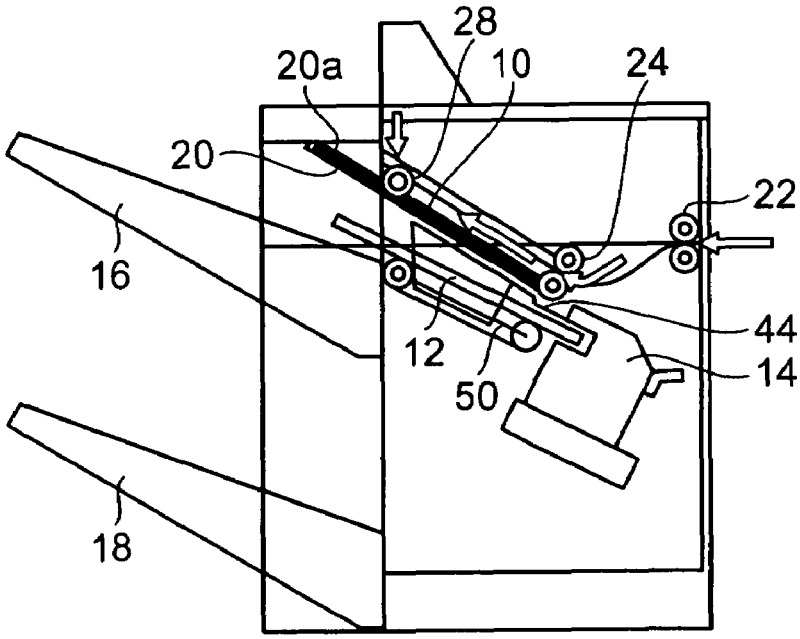
FIG. 11 is a view for explaining an operation of the standby tray roller in the sheet post-process apparatus according to the embodiment of the present invention.

When the preparation is completed, as shown in FIG. 11, the second sheet 20*a* is sent to the standby tray 10, the standby tray roller 28 is lowered, and the position of the sheet is aligned to the rear end 60 of the standby tray 10. Thus, a sheet bundle 20*b* having two sheets 20, 20*a* is formed on the standby tray 10.

Figure 12:
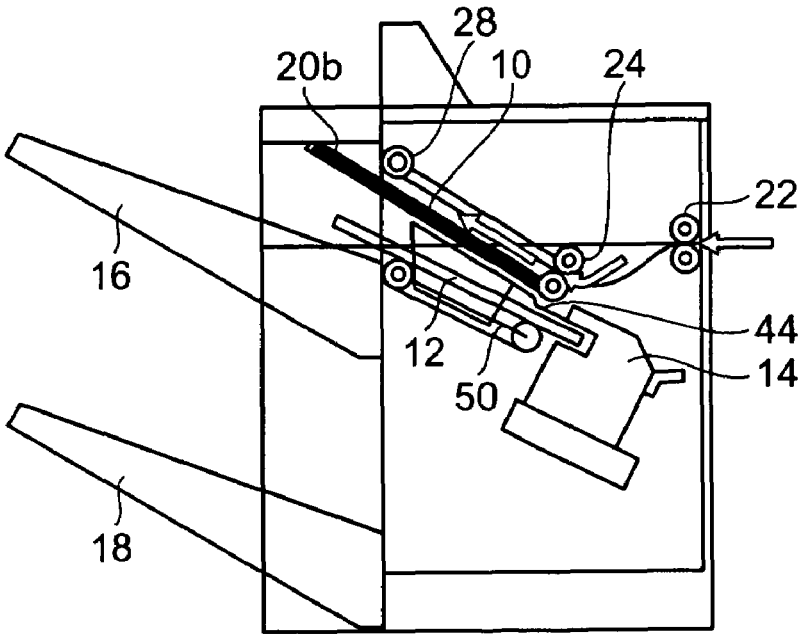
FIG. 12 is a view for explaining an operation of the standby tray roller in the sheet post-process apparatus according to the embodiment of the present invention.
Figure 13:
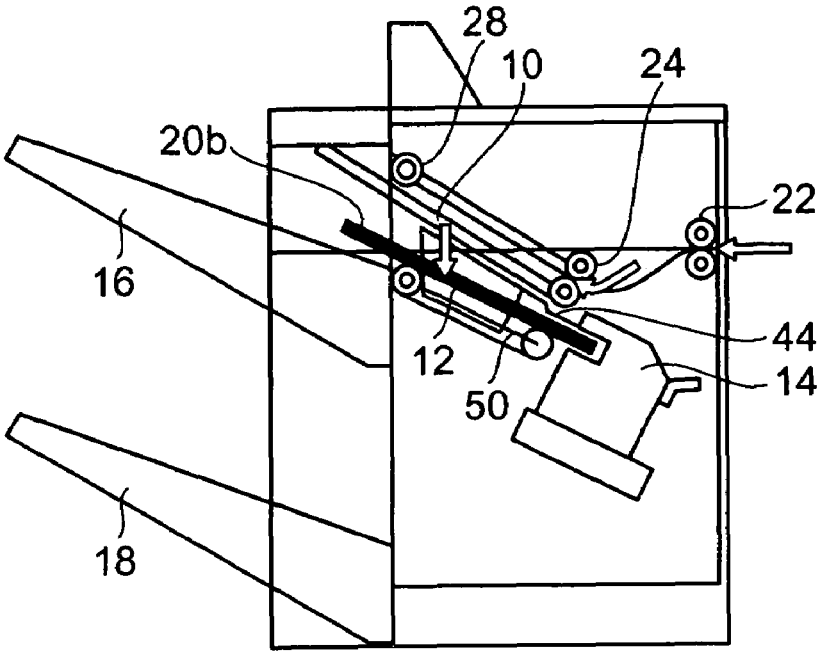
FIG. 13 is a view for explaining an operation of an active drop in the sheet post-process apparatus according to the embodiment of the present invention.

Then, as shown in FIG. 12, the standby tray roller 28 is raised, as further shown in FIG. 3, the standby tray components 10*a*, 10*b* are opened, the active drop is performed as shown in FIG. 13, and the sheet bundle 20*b* is sent to the process tray 12.

Figure 14:
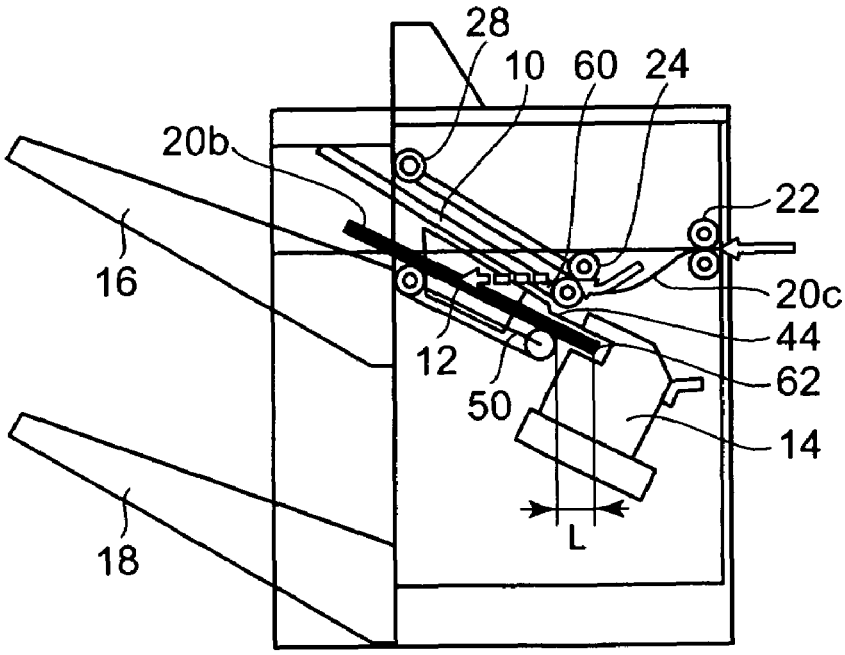
FIG. 14 is a view for explaining a flow of a third sheet between the sheet feed roller and the standby tray in the sheet post-process apparatus according to the embodiment of the present invention.

Thereafter, the third and subsequent sheets 20*c* are sent directly from the sheet feed roller 24 to the process tray 12 not through the standby tray 10 as shown in FIG. 14, and accumulated on the second sheet bundle 20*b* to form the sheet bundle 21 of a predetermined number of sheets. Then, the longitudinal matching mechanism 38 and the lateral matching mechanism 47 operate to perform the sheet matching of longitudinal and lateral directions.

In this case, as shown in FIG. 14, the rear end 60 of the standby tray 10 and the rear end 62 of the process tray 62 are spaced at a distance L in the lateral direction so that the rear end of the standby tray 10 is located at a downstream side from the rear end (upstream side) 62 of the process tray 12. When thus constituted, dropping of the sheet bundle 20*b* from the standby tray 10 to the process tray 12 is facilitated, and the matching operation of the longitudinal matching mechanism 38 and the lateral matching mechanism 47 can be facilitated. As a result, occurrence of a jam or the like can be prevented.

Desirably, arrangement of he standby tray 10 and the process tray 12 are obliquely inclined. That is, the rear ends 60 and 62 are disposed at the lowest position, and the sheets 20 and the sheet bundle 21 can be matched to the rear ends 60 and 62 by the own weights of the sheet 20 and the sheet bundle 21.

Figure 15:
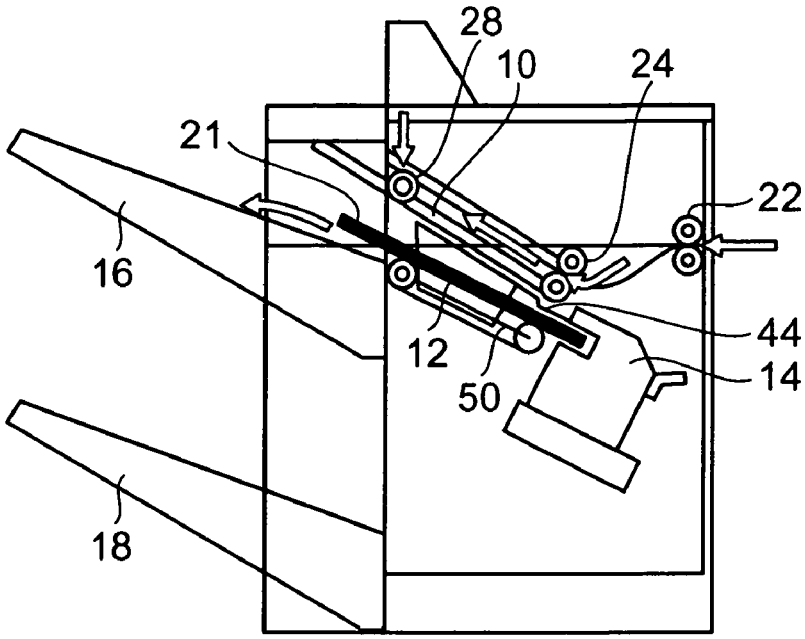
FIG. 15 is a view for explaining an operation of a stapler in the sheet post-process apparatus according to the embodiment of the present invention.
Figure 16:
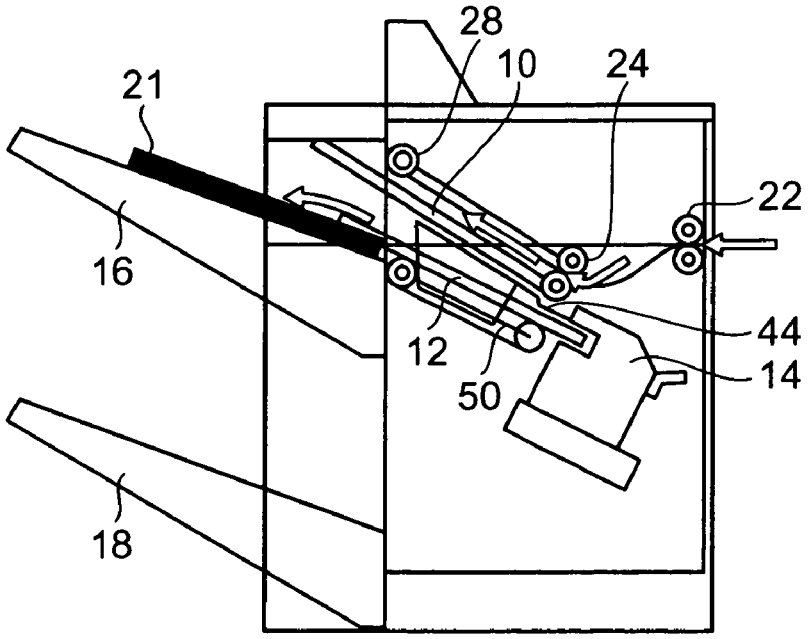
FIG. 16 is a view for explaining a flow of a sheet bundle between a process tray and a sheet delivery tray in the sheet post-process apparatus according to the embodiment of the present invention.

Then, as shown in FIG. 15, the sheet bundle 21 is staple processed by the stapler 14. As shown in FIG. 16, the sheet bundle 21 is sent to the sheet delivery tray 16 by the conveying mechanism 50, and thereby the post-process is completed.

Figure 17:
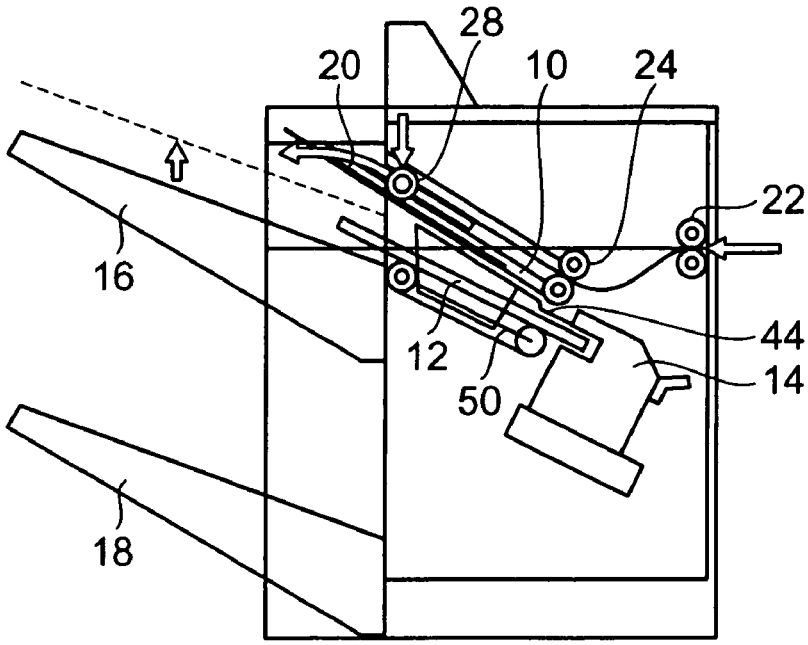
FIG. 17 is a view for explaining a flow of a direct sheet delivery of a sheet from a standby tray to the sheet delivery tray in the sheet post-process apparatus according to the embodiment of the present invention.
Figure 18:
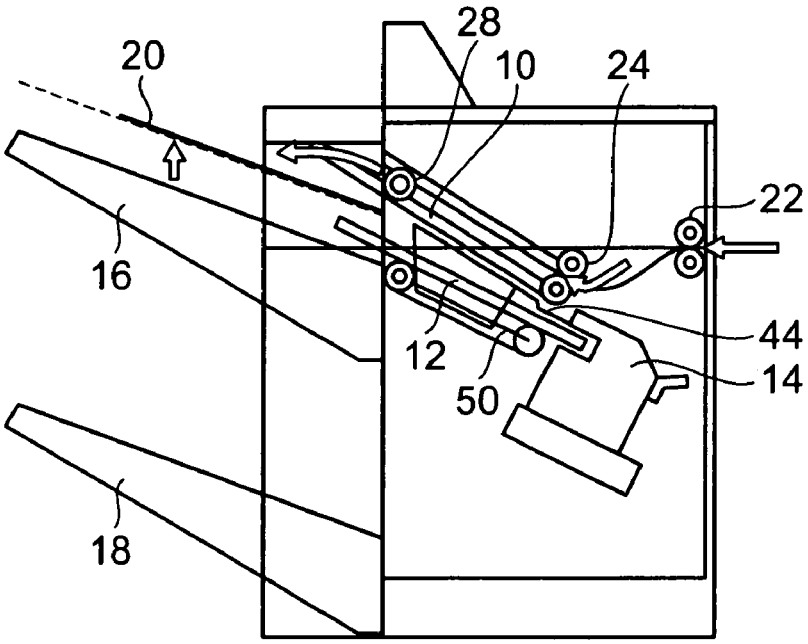
FIG. 18 is a view for explaining an operation of a position change of a sheet delivery tray in the sheet post-process apparatus according to the embodiment of the present invention.

Note that, when the post-process is not required, as shown in FIG. 17 and FIG. 18, the sheet is delivered directly from the standby tray 10 to the sheet delivery tray 16 without intermediary of the process tray 12. As shown in FIG. 17, the sheet fed from the MFP is sent to the sheet delivery tray 16 through the inlet roller 22, the sheet supply roller 24 and the standby tray 10. The standby tray roller 28 is lowered to convey the sheet 20. The sheet delivery tray 16 is slightly raised, as shown in FIG. 18, by the sheet delivery tray driver 52, and receives the sheet fed from the standby tray 10.

In this embodiment, the post-process of the sheet made of paper has been described. However, the matter post-processed according to the present invention is not limited only to the paper, but may be an OHP or the other, a sheet-like recording medium, which is here called a sheet.

The post-process in the present invention is, for example, a staple process for bundling a plurality of printed sheets and binding the sheets. However, the present invention is not limited to this.

In the description of the above embodiment, the case that the present invention is applied to the MFP has been described. However, the present invention is not limited to this, but can be applied to a general post-process of the sheet printed by the image forming apparatus.

In the foregoing description, an embodiment of the present invention has been described. However, the present invention is not limited to the above-mentioned embodiment, but the constituting elements can be altered in a range that the same technical thought as the present invention, and these elements may be included in the present invention.

What is claimed is:

1. A sheet post-process apparatus, comprising:

a standby tray for putting sheets delivered from an image forming apparatus on standby;

a process tray arranged under the standby tray for stacking the sheets dropped from the standby tray and sheets delivered from the image forming apparatus not through the standby tray;

a matching mechanism for matching a lateral direction of the sheets stacked on the process tray by a lateral matching plate to form a sheet bundle;

a post-process mechanism for post-processing the sheet bundle matched by the matching mechanism; and a delivery tray for receiving the sheet bundle post-processed by the post-process mechanism;

wherein the process tray and the standby tray are arranged such that an upper end of the lateral matching plate of the process tray abuts bottom surface of the standby tray.

2. The sheet post-process apparatus according to claim 1, wherein the process tray and the standby tray are arranged such that portions of the upper end of the lateral matching plate of the process tray are formed integral with the bottom surface of the standby tray.

3. The sheet post-process apparatus according to claim 1, wherein the process tray and the standby tray are arranged such that the upper end of the lateral matching plate of the process tray extends through the bottom surface of the standby tray.

4. The sheet post-process apparatus according to claim 1, wherein the standby tray includes tray components.

5. The sheet post-process apparatus according to claim 4, wherein the tray components open in a horizontal direction.

6. The sheet post-process apparatus according to claim 1, further comprising a conveying mechanism to convey the sheet bundle to the delivery tray.

7. The sheet post-process apparatus according to claim 1, further comprising a longitudinal alignment mechanism.

8. A sheet post-process apparatus, comprising:

a standby tray for putting sheets delivered from an image forming apparatus on standby;

a process tray arranged under the standby tray for stacking the sheets dropped from the standby tray and sheets delivered from the image forming apparatus not through the standby tray;

a matching mechanism for matching a lateral direction of the sheets stacked on the process tray by a lateral matching plate to form a sheet bundle;

post-process means for post-processing the sheet bundle matched by the matching mechanism; and sheet bundle receiving means for receiving the sheet bundle post-processed by the post-process means, wherein the process tray and the standby tray are arranged such that an upper end of the lateral matching plate of the process tray abuts a bottom surface of the standby tray.

9. The sheet post-process apparatus according to claim 8, wherein the process tray and the standby tray are arranged such that portions of the upper end of the lateral matching plate of the process tray are formed integral with the bottom surface of the standby tray.

10. The sheet post-process apparatus according to claim 8, wherein the process tray and the standby tray are arranged such that the upper end of the lateral matching plate of the process tray extends through the bottom surface of the standby tray.

11. The sheet post-process apparatus according to claim 8, wherein the standby tray includes tray components.

12. The sheet post-process apparatus according to claim 11, wherein the tray components open in a horizontal direction.

13. The sheet post-process apparatus according to claim 8, further comprising a conveying mechanism to convey the sheet bundle to the sheet bundle receiving means.

14. The sheet post-process apparatus according to claim 8, further comprising a longitudinal alignment mechanism.

15. A method for post-processing sheets, comprising:

placing sheets delivered from an image forming apparatus on a standby tray;

stacking the sheets dropped from the standby tray and sheets delivered from the image forming apparatus not through the standby tray on a process tray which is arranged under the standby tray;

matching a lateral direction of the sheets stacked on the process tray by a lateral matching plate to form a sheet bundle;

post-processing the sheet bundle matched by the lateral matching plate; and receiving the sheet bundle that has been post-processed, wherein the process tray and the standby tray have been arranged such that an upper end of the lateral matching plate of the process tray abuts a bottom surface of the standby tray.

16. The method for post-processing sheets according to claim 15, wherein the process tray and the standby tray are arranged such that portions of the upper end of the lateral matching plate of the process tray are formed integral with the bottom surface of the standby tray.

17. The method for post-processing sheets according to claim 15, wherein the process tray and the standby tray are arranged such that the upper end of the lateral matching plate of the process tray extends through the bottom surface of the standby tray.

18. The method for post-processing sheets according to claim 15, further comprising opening the standby tray in a horizontal direction.

19. The method for post-processing sheets according to claim 15, further comprising conveying the sheet bundle to a delivery tray.

20. The method for post-processing sheets according to claim 15, further comprising aligning the sheets on the process tray in a longitudinal direction.

* * * * *